US009078070B2

(12) United States Patent
Samuels

(10) Patent No.: US 9,078,070 B2
(45) Date of Patent: Jul. 7, 2015

(54) HEARING INSTRUMENT CONTROLLER

(75) Inventor: Howard R. Samuels, Newton, MA (US)

(73) Assignee: Analog Devices, Inc., Norwood, MA (US)

( * ) Notice: Subject to any disclaimer, the term of this patent is extended or adjusted under 35 U.S.C. 154(b) by 183 days.

(21) Appl. No.: 13/114,193

(22) Filed: May 24, 2011

(65) Prior Publication Data

US 2012/0300965 A1 Nov. 29, 2012

(51) Int. Cl.
*H04R 25/00* (2006.01)

(52) U.S. Cl.
CPC ..... *H04R 25/00* (2013.01); *H04R 2225/021* (2013.01); *H04R 2225/025* (2013.01); *H04R 2225/41* (2013.01); *H04R 2225/61* (2013.01); *H04R 2430/01* (2013.01); *H04R 2460/03* (2013.01)

(58) Field of Classification Search
CPC .... H04R 25/652; H04R 25/456; H04R 25/65; H04R 25/602; H04R 2225/41; H04R 2225/61
USPC ..... 381/328, 323
See application file for complete search history.

(56) References Cited

U.S. PATENT DOCUMENTS

| | | | | |
|---|---|---|---|---|
| 5,314,453 | A | 5/1994 | Jeutter | 607/61 |
| 5,553,152 | A | 9/1996 | Newton | 381/68.6 |
| 5,704,352 | A | 1/1998 | Tremblay et al. | 128/630 |
| 5,824,014 | A | 10/1998 | Thong et al. | 607/4 |
| 5,846,189 | A | 12/1998 | Pincus | 600/301 |
| 5,959,529 | A | 9/1999 | Kail, IV | 340/539 |
| 6,029,074 | A | 2/2000 | Irvin | 455/571 |
| 6,358,281 | B1 | 3/2002 | Berrang et al. | 623/10 |
| 6,540,662 | B2 * | 4/2003 | Kroll et al. | 600/25 |
| 6,580,947 | B1 | 6/2003 | Thompson | 607/30 |
| 7,016,705 | B2 | 3/2006 | Bahl et al. | 455/566 |
| 7,526,389 | B2 | 4/2009 | Greenwald et al. | 702/55 |
| 7,529,587 | B2 | 5/2009 | Single | 607/57 |
| 8,130,205 | B2 | 3/2012 | Forstall et al. | 345/173 |
| 8,239,160 | B2 | 8/2012 | Lee et al. | 702/141 |
| 2002/0099412 | A1 | 7/2002 | Fischell et al. | 607/3 |
| 2005/0164633 | A1 | 7/2005 | Linjama et al. | 455/41.2 |
| 2005/0196009 | A1 * | 9/2005 | Boesen | 381/380 |
| 2006/0119508 | A1 | 6/2006 | Miller | 342/357.17 |
| 2006/0148490 | A1 | 7/2006 | Bates et al. | 455/456.1 |

(Continued)

FOREIGN PATENT DOCUMENTS

| | | | | |
|---|---|---|---|---|
| DE | 102006028682 A1 * | 1/2008 | | G01H 3/00 |
| WO | WO 2012/103320 | 8/2012 | | H04R 25/00 |

OTHER PUBLICATIONS

Weinberg, "Minimizing Power Consumption of iMEMS® Accelerometers," Analog Devices, Inc., AN-601 Application Note, 8 pages, 2002.

(Continued)

*Primary Examiner* — Duc Nguyen
*Assistant Examiner* — Sean H Nguyen
(74) *Attorney, Agent, or Firm* — Ropes & Gray LLP

(57) ABSTRACT

A hearing instrument has a plurality of electronic components within a body, and an inertial sensor mechanically coupled with the body. The inertial sensor is configured to monitor the motion of the body and generate a movement signal representative of the body motion. A controller operatively coupled with the inertial sensor controls power usage by at least one or more of the electronic components as a function of the movement signal.

18 Claims, 3 Drawing Sheets

(56) References Cited

U.S. PATENT DOCUMENTS

| | | | | |
|---|---|---|---|---|
| 2006/0173259 | A1 | 8/2006 | Flaherty et al. | 600/331 |
| 2006/0174685 | A1 | 8/2006 | Skvortsov et al. | 73/1.37 |
| 2007/0154030 | A1 | 7/2007 | Moses | 381/72 |
| 2007/0268108 | A1 | 11/2007 | Weinberg et al. | 340/3.1 |
| 2008/0208280 | A1 | 8/2008 | Lindenthaler et al. | 607/42 |
| 2009/0030350 | A1 | 1/2009 | Yang et al. | 600/595 |
| 2009/0034769 | A1 | 2/2009 | Darley et al. | 381/328 |
| 2009/0195497 | A1 | 8/2009 | Fitzgerald et al. | 345/156 |
| 2009/0240463 | A1 | 9/2009 | Lee et al. | 702/141 |
| 2009/0257608 | A1* | 10/2009 | Chew et al. | 381/312 |
| 2009/0293615 | A1 | 12/2009 | Lee | 73/514.01 |
| 2009/0306743 | A1 | 12/2009 | Van Den Heuvel | 607/57 |
| 2010/0114060 | A1 | 5/2010 | Ginggen | 604/500 |
| 2010/0142738 | A1 | 6/2010 | Zhang et al. | 381/315 |
| 2010/0246836 | A1* | 9/2010 | Johnson et al. | 381/58 |
| 2010/0246847 | A1* | 9/2010 | Johnson et al. | 381/74 |
| 2010/0287770 | A1 | 11/2010 | Dadd et al. | 29/877 |
| 2010/0292759 | A1 | 11/2010 | Hahn et al. | 607/57 |
| 2010/0302025 | A1* | 12/2010 | Script | 340/539.1 |
| 2010/0302028 | A1 | 12/2010 | Desai et al. | 340/539.3 |
| 2011/0018794 | A1 | 1/2011 | Linsky et al. | 345/156 |
| 2011/0130622 | A1* | 6/2011 | Ilberg | 600/25 |
| 2011/0158443 | A1* | 6/2011 | snes et al. | 381/326 |
| 2011/0230228 | A1 | 9/2011 | Young et al. | 455/550.1 |
| 2012/0022616 | A1* | 1/2012 | Garnham et al. | 607/60 |
| 2012/0197345 | A1 | 8/2012 | Staller | 607/57 |

OTHER PUBLICATIONS

Analog Devices, Inc., "The Five Motion Senses: Using MEMS Inertial Sensing to Transform Applications," Analog.com/inertialsensors, 3 pages, 2009.

* cited by examiner

HEARING INSTRUMENT CONTROLLER

FIELD OF THE INVENTION

The invention generally relates to hearing instruments and, more particularly, the invention relates to controlling the operation of hearing instruments.

BACKGROUND OF THE INVENTION

Hearing instruments (e.g., hearing aids and cochlear implant sound processors) typically have a number of mechanical user controls for controlling instrument operation. For example, some mechanical user controls include switches and knobs for 1) making volume adjustments, 2) turning the power off and on, or 3) changing between operating modes or programs.

The size of hearing instruments, however, continues to shrink. Accordingly, the manufacture of, use of, and access to these mechanical controls is becoming increasingly difficult. Moreover, mechanical components often expose the instrument interior to moisture and contaminants, creating reliability problems and further reducing device longevity.

SUMMARY OF THE INVENTION

In accordance with one embodiment of the invention, a hearing instrument has a plurality of electronic components within a body, and an inertial sensor mechanically coupled with the body. The inertial sensor is configured to monitor the motion of the body and generate a movement signal representative of the body motion. A controller operatively coupled with the inertial sensor controls power usage by at least one or more of the electronic components as a function of the movement signal.

The inertial sensor may include a low power accelerometer that draws no more than about one microamp of current during operation. For example, during a given period in which some of the noted components (i.e., at least some of the electronic components) are on about ⅔ of the total given period, the inertial sensor (e.g., an accelerometer or other inertial sensor) may draw less than about 10 percent of the total power draw of the hearing instrument during the entire given period.

The controller may permit the components to consume a first amount of power in a first mode, and a second amount of power in a second mode. The first amount of power is less than the second amount of power. As an example, the components may be substantially stationary when in the first mode. The second mode thus is defined by a time period in which the body or components are moving during at least some portion of that time period. The controller thus may include logic for determining when the components are substantially stationary for a pre-defined period of time.

Among other ways, the controller may include a polling apparatus, operatively coupled with the inertial sensor, for periodically polling the inertial sensor to determine whether to change the power draw of the components. The controller also may use interrupts to control operation. The hearing instrument may include an implantable portion, and an external portion for communicating with the implantable portion. The external portion and implantable portion may have corresponding induction coils for permitting the external portion to power the implantable portion. In addition, the components may be a part of the external portion.

Some embodiments have a power module for powering the components. The controller thus may be operatively coupled with the power module to control power consumption of the components.

In accordance with another embodiment of the invention, a method of operating a hearing instrument determines, for a given period of time, if the hearing instrument is stationary, and controls the hearing instrument to draw power as a function of that determination. The hearing instrument draws power at a first rate after determining that the hearing instrument is substantially stationary, and draws power at a second rate after determining that the hearing instrument is not substantially stationary. The first rate is less than the second rate.

In accordance with other embodiments of the invention, a hearing instrument includes a signal module for both 1) processing an incoming acoustic signal and 2) generating an output signal representative of the incoming acoustic signal, and a control module (operatively coupled with the signal module) that controls operation of the signal module. The instrument also includes an inertial sensor for detecting any one of a plurality of input inertial signals. The control module controls operation of the signal module in response to input inertial signals detected by the inertial sensor.

The input inertial signals may include a tap or a finger press on the body of the instrument. The control module may control the volume of the output signal. Moreover, one or both the control module and the signal module may have a plurality of programs for generating the output signal. In that case, the control module may control selection of any of the plurality of programs as a function of the input inertial signal detected by the inertial sensor.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

Figure 1A:
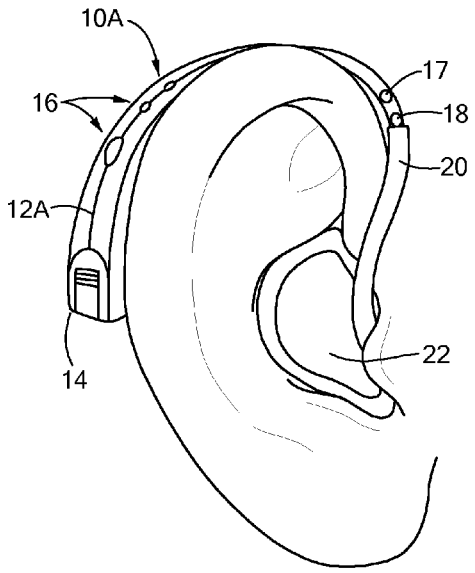
FIG. 1 schematically shows a plurality of different types of hearing aids that may incorporate illustrative embodiments of the invention.
Figure 1B:
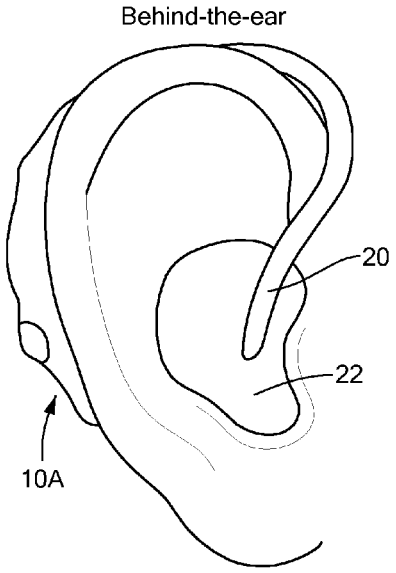
Figure 1C:
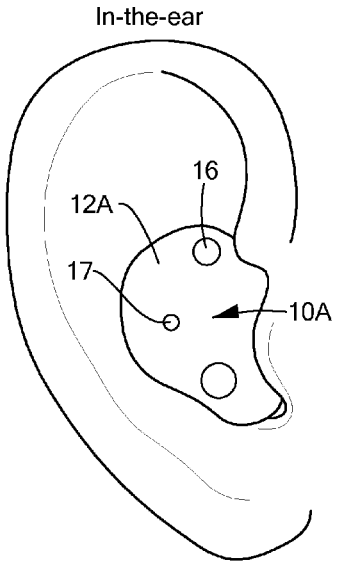
Figure 1D:
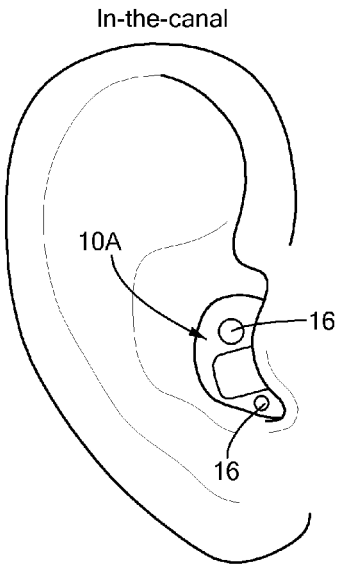

In illustrative embodiments, a hearing instrument automatically determines whether it is on or off—without direct user interaction—no "off" or "on" switch is necessary. In addition, some embodiments eliminate the need for other manual controls, such as volume control or program selection buttons. To those ends, the hearing instrument includes one or more inertial sensors that enable appropriate action based upon motion or inertial signals. In addition to saving power (in some instances) and improving device robustness, this enables a new and easier paradigm for controlling hearing instruments. Details of illustrative embodiments are discussed below.

Various embodiments apply to hearing instruments, which, in this context, are either hearing aids or cochlear implant systems (also referred to as "cochlear implants," or "cochlear implant sound processors"). People thus use hearing instruments because of a medical need, such as a limited ability to hear the spoken word or other normally audible signals. This is in contrast to listening devices that are not considered hearing instruments, such as speakers, headphones (e.g., headphone sold by Apple Inc. under the trademark EARBUDS), cellular telephones, headsets, and televisions. Accordingly, the term "hearing instrument" is used herein with reference to hearing aids and cochlear implant systems only. Hearing instruments are identified in this document as "hearing instruments 10," hearing aids are identified by reference number 10A, and cochlear implants are identified by reference number 10B.

To those ends, FIG. 1 illustratively shows three different types of hearing aids 10A that may incorporate illustrative embodiments of the invention. Drawings A and B of FIG. 1 show different "behind the ear" types of hearing aids 10A that, as their name suggests, have a significant portion secured behind the ear during use. In contrast, drawings C and D show hearing aids 10A that do not have a component behind the ear. Instead, these types of hearing aids 10A mount within the ear. Specifically, drawing C shows an "in-the-ear" hearing aid 10A which, as its name suggests, mounts in-the-ear, while drawing D shows an "in-the-canal" hearing aid 10A which, as its name suggests, mounts more deeply in the ear—namely, in the ear canal.

With reference to drawing A of FIG. 1, the intelligence and logic of the behind the ear type of hearing aid 10A lies primarily within a housing 12A that mounts behind the ear. To that end, the housing 12A forms an interior chamber that contains internal electronics for processing audio signals, a battery compartment 14 (a powering module) for containing a battery that powers the hearing aid 10A, and mechanical controlling features 16, such as knobs, for controlling the internal electronics. In addition, the hearing aid 10A also includes a microphone 17 for receiving audio signals, and a speaker 18 for transmitting amplified audio signals received by the microphone 17 and processed by the internal electronics. A hollow tube 20 directly connected to the end of the hearing aid 10A, right near the speaker 18, channels these amplified signals into the ear. To maintain the position of this tube 20 and mitigate undesired feedback, the hearing aid 10A also may include an ear mold 22 (also part of the body of the hearing aid 10A) formed from soft, flexible silicone molded to the shape of the ear opening.

Among other things, the hearing aid 10A may have logic for optimizing the signal generated through the speaker 18. More specifically, the hearing aid 10A may have certain program modes that optimize signal processing in different environments. For example, this logic may include filtering systems that produce the following programs:

normal conversation in a quiet environment,
normal conversation in a noisy environment,
listening to a movie in a theater, and
listening to music in a small area.

The hearing aid 10A also may be programmed for the hearing loss of a specific user/patient. It thus may be programmed to provide customized amplification at specific frequencies.

The other two types of hearing aids 10A typically have the same internal components, but in a smaller package. Specifically, the in-the-ear hearing aid 10A of drawing C has a flexible housing 12A with the internal components and molded to the shape of the ear opening. In particular, among other things, those components include a microphone 17 facing outwardly for receiving audio signals, a speaker (not shown) facing inwardly for transmitting those signals into the ear, and internal logic for amplifying and controlling performance.

The in-the-canal hearing aid 10A of drawing D typically has all the same components, but in a smaller package to fit in the ear canal. Some in-the-canal hearing aids 10A also have an extension (e.g., a wire) extending out of the ear to facilitate hearing aid removal.

Figure 2:
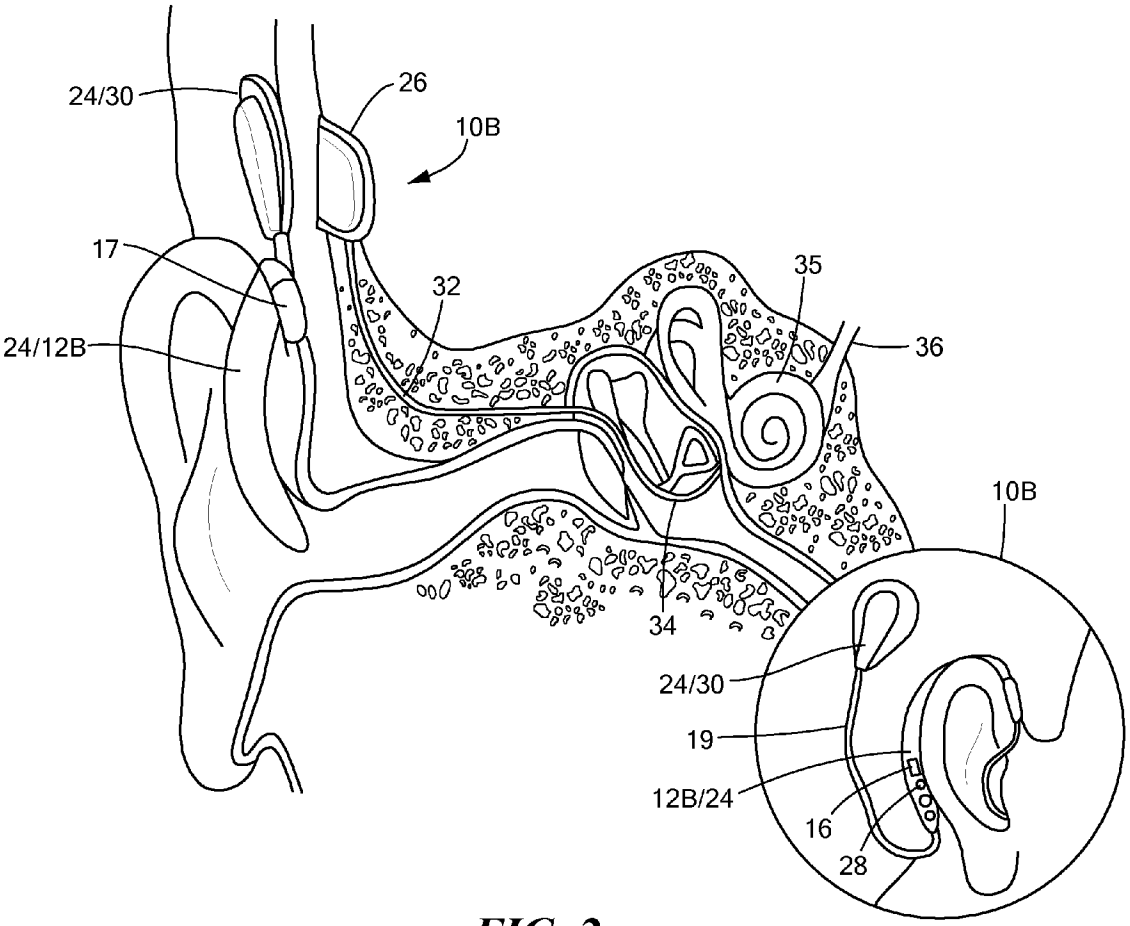
FIG. 2 schematically shows on example of a cochlear implant that may incorporate illustrative embodiments of the invention.

FIG. 2 schematically shows the second noted type of hearing instrument 10, a cochlear implant 10B. At a high level, a cochlear implant 10B has the same function as that of a hearing aid 10A; namely, to help a person hear normally audible sounds. A cochlear implant 10B, however, performs its function in a different manner by having an external portion 24 that receives and processes signals, and an implanted portion 26 physically located within a person's head.

To those ends, the external portion 24 of the cochlear implant 10B has a behind the ear portion with many of the same components as those in a hearing aid 10A behind the ear portion. The larger drawing in FIG. 2 shows this behind the ear portion as a transparent member since the ear covers it, while the smaller drawing of that same figure shows it behind the ear.

Specifically, the behind the ear portion includes a housing/body 12B that contains a microphone 17 for receiving audio signals, internal electronics for processing the received audio signals, a battery, and mechanical controlling knobs 16 for controlling the internal electronics. Those skilled in the art often refer to this portion as the "sound processor" or "speech processor." A wire 19 extending from the sound processor connects with a transmitter 30 magnetically held to the exterior of a person's head. The speech processor communicates with the transmitter 30 via the wire 19.

The transmitter 30 includes a body having a magnet that interacts with the noted implanted metal portion 26 to secure it to the head, wireless transmission electronics to communicate with the implanted portion 26, and a coil to power the implanted portion 26 (discussed below). Accordingly, the microphone 17 in the sound processor receives audio signals, and transmits them in electronic form to the transmitter 30 through the wire 19, which subsequently wirelessly transmits those signals to the implanted portion 26.

The implanted portion 26 thus has a receiver with a microprocessor to receive compressed data from the external transmitter 30, a magnet having an opposite polarity to that in the transmitter 30 both to hold the transmitter 30 to the person's head and align the coils within the external portion 24/transmitter 30, and a coil that cooperates with the coil in the exterior transmitter 30. The coil in the implanted portion 26 forms a transformer with the coil of the external transmitter 30 to power its own electronics. A bundle of wires 32 extending from the implanted portion 26 passes into the ear canal and terminates at an electrode array 34 mounted within the cochlea 35. As known by those skilled in the art, the receiver transmits signals to the electrode array 34 to directly stimulate the auditory nerve 36, thus enabling the person to hear sounds in the audible range of human hearing.

Prior art hearing instruments, including those shown in FIGS. 1 and 2, typically had mechanical components 16 (e.g., knobs, switches, and dials) on its body to turn the hearing aid 10A on and off. For example, the battery compartment often functioned as the power switch, while a knob controlled volume. These mechanical components 16 also may control the volume of the output sound (e.g., the amplitude of the amplified audio signal of a hearing aid 10A), the program selection, and other functions. FIG. 1 explicitly shows some of these mechanical components 16 on the different types of hearing aids 10A.

As a person who has used hearing instruments 10, the inventor realized the difficulties of these mechanical controls 16 firsthand. Specifically, as these devices become smaller and smaller, so do the mechanical switches and knobs 16. This is exacerbated when used by a typical user, such as a senior citizen, who often has reduced manual dexterity. Moreover, mechanical knobs 16 often are a principal source of device failure by breaking, and by providing exposed areas for moisture and contaminants access into the housing 12A or 12B.

The inventor discovered that these mechanical features 16 can be reduced or eliminated by embedding an inertial sensor 46 (e.g., see FIG. 3) somewhere within the hearing instrument 10. Specifically, the inventor realized that the internal circuitry can respond to inertial signals—rather than signals from tiny and fragile mechanical controls 16—to control hearing instrument operation. For example, the volume can be increased or decreased, or the program can be changed, when the inertial sensor 46 detects a tap on certain parts of the instrument 10, or on the person's head.

The inventor discovered this phenomenon despite the countervailing drive to reduce the available space within hearing instruments 10, thus limiting the ability for a hearing instrument 10 to contain an extra component, such as an inertial sensor 46. As discussed below, certain inertial sensors can be sized small enough to have a negligible impact on this limited space. In addition, rather than draw more power, which is antithetical to current hearing instrument trends, the inertial sensor 46 can control the power draw at least to minimize its power footprint in the instrument 10 to a negligible level.

Illustrative embodiments may use any of a variety of different types of inertial sensors. Among others, low power, low profile, low-G one-axis, two-axis, or three-axis accelerometers should suffice. For example, the ADXL346 accelerometer (a 3-axis accelerometer), distributed by Analog Devices, Inc. of Norwood Mass., may suffice, although its current draw may be greater than 25 microamps. As another example, a wafer level, chip scale package having a low power, low-G MEMS accelerometer also may suffice. Other embodiments may use gyroscopes or other MEMS devices (e.g., pressure sensors).

Illustrative embodiments therefore use the inertial sensor 46 to either augment the mechanical components 16, or completely replace them to improve reliability. The inertial sensor 46 also enables intelligent power management, thus reducing the likelihood that the instrument 10 will unnecessarily remain "on" when not in use. Accordingly, the mere act of placing the hearing instrument 10 onto a person's head can cause the electronics to energize. In a corresponding manner, the mere act of placing a hearing instrument 10 onto a table (for preselected amount of time), such as a night table, can cause an automatic power down of the electronics (e.g., almost all of the electronics). There would be no need for the user to remember to turn off the hearing instrument 10 at the end of the day, or to struggle manipulating a small and fragile mechanical switch.

In addition, as another example, a user simply may tap the top of a hearing instrument 10 to increase the volume, or tap the back of the hearing instrument 10 to decrease the volume. A user also may tap another portion of the hearing instrument 10 to cycle through the different program modes. Of course, the hearing instrument 10 can be configured to respond to different patterns of tapping and types of tapping and thus, the discussion of tapping on specific areas is for illustrative purposes only.

In-the-ear hearing aids 10A and in-the-canal hearing aids 10A have only one exposed surface to tap, however, which can present certain challenges. Various embodiments, however, are programmed to convert taps on the person's head into volume control, programming control, or other hearing instrument functions. Embodiments that convert tapping patterns to controls also provide a satisfactory means for controlling the instrument 10. For example, two quick successive tabs can increase the volume, while two slow taps can decrease the volume.

Figure 3:
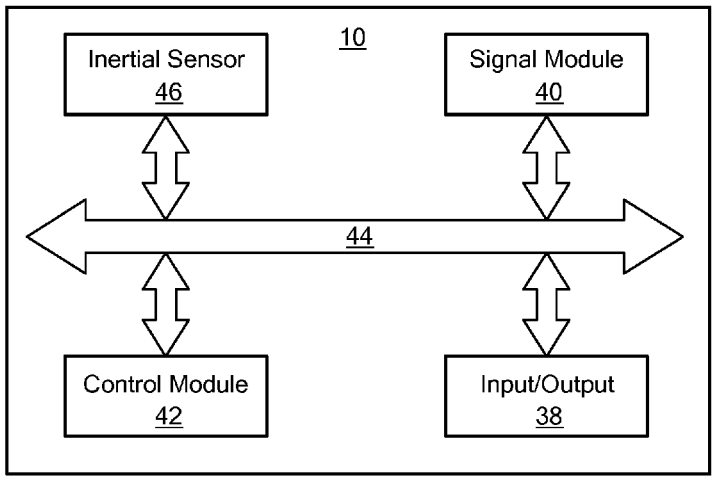
FIG. 3 schematically shows various interior components of a hearing instrument incorporating illustrative embodiments of the invention.

FIG. 3 schematically shows a block diagram of a hearing instrument 10 incorporating illustrative embodiments of the invention. The logic shown in this figure can be incorporated into any of the hearing instruments 10 shown in FIGS. 1 and 2. Accordingly, illustrative embodiments can augment the functions of the mechanical controllers 16 of the hearing instrument 10 shown in those figures. Alternatively, illustrative embodiments can eliminate those same mechanical controllers 16.

To that end, the hearing instrument 10 has an input/output module 38 for receiving an audio signal (e.g., a microphone 17), and a signal module 40 that performs any of a number of different functions to the input signal. For example, the signal module 40 in a hearing aid 10A may amplify the input signal, while that in a cochlear implant 10B may digitize and compress the audio signal. In either type of hearing instrument 10, the signal module 40 may filter and otherwise process the input signal.

A control module 42, which is operatively coupled with the signal module 40 through a bus 44 or other interconnect, controls the signal module 40 and other components within the hearing instrument 10. This control may be a function of signals received from an inertial sensor 46 (e.g., via a tap), such as an accelerometer and/or gyroscope. The hearing instrument 10 delivers its output signal to the person through the input/output module 38. For example, the above noted speaker 18 in the input/output module 38 of a hearing aid 10A would provide this function.

In illustrative embodiments, the inertial sensor 46 may be physically positioned within the housing 12A of the behind the ear hearing aids 10A, or within the sound processor housing 12B of the cochlear implant 10B. The inertial sensor 46 thus may be considered to be mechanically coupled with the microphone 17 receiving the audio signal and other components within the instrument 10 (e.g., mechanically coupled with the instrument body). Accordingly, the signal that the inertial sensor 46 generates substantially directly represents the motion of the microphone 17, the signal module 40, the body, and other internal components.

It also should be noted that the functionality of different modules of FIG. 3 can be shared or spread to other functional modules. For example, the inertial sensor 46 may have embedded intelligence/electronics that performs some of the control functions. As a second example, the input/output module 38 typically are two different components, although they are shown as a single block module.

Figure 4:
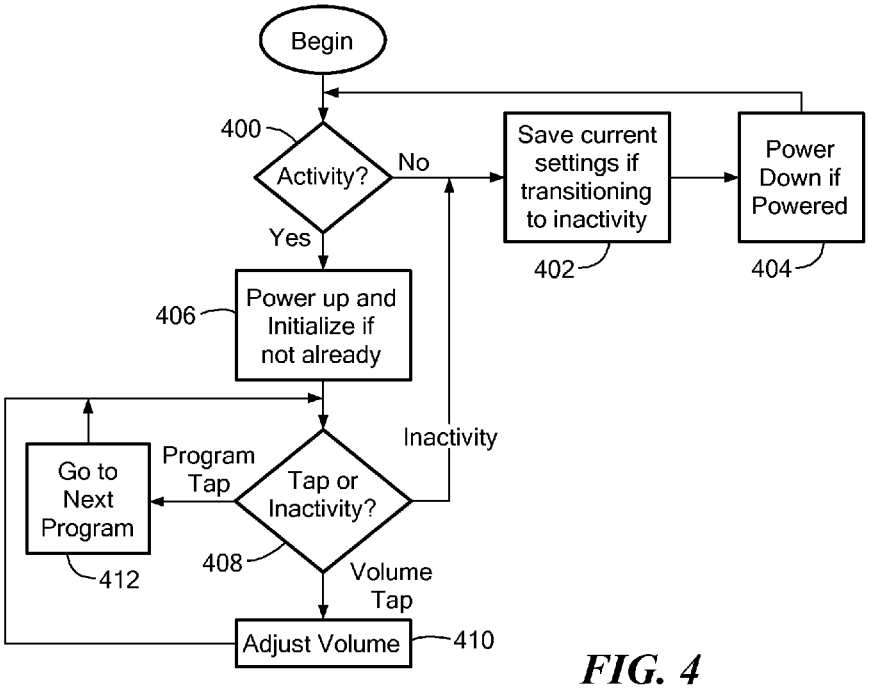
FIG. 4 schematically shows a process for controlling hearing instrument functionality based upon inertial signals.

FIG. 4 shows a process for controlling hearing instrument functionality based upon inertial signals. This process may be performed in hardware, software (e.g., a computer program product having a tangible medium with code thereon), or some combination thereof. Moreover, this process shows a few of the many steps of the process of controlling hearing instrument functionality. Accordingly, discussion of this process should not be considered to include all necessary steps, or the steps could be performed in a different order.

The process begins at step 400, in which the control module 42 determines if the hearing instrument 10 is in a period of "activity," or a period of "inactivity." More specifically, the control module 42 determines if the hearing instrument 10 is in use, in which case it should be secured to a person's head, or not in use, in which case it would be substantially stationary (e.g., sitting on a night stand) or in some storage area. Illustrative embodiments can use any of a number of different techniques for detecting activity and inactivity.

For example, when detecting activity, the control module 42 may capture and store an acceleration offset or bias upon the start of looking for activity. The accelerometer then may measure a current acceleration at a prescribed data rate and compare the measured acceleration to the acceleration bias to look for a difference greater than an activity threshold.

For inactivity detection, a similar technique may be used along with a timer. Specifically, when inactivity detection is desired, the measured acceleration data is compared to the stored acceleration bias. The process continues until the change in acceleration is less than the inactivity threshold for a desired period of time.

Such embodiments monitor activity and/or inactivity, and detect when it changes—even 1) in the presence of a constant acceleration such as the earth's 1-G gravitational field and 2) when the change in acceleration or orientation is less than 1 G. The control module 42 may use digital logic and state machines to make these determinations. For additional details of this and other similar techniques for detecting activity and inactivity, see co-pending U.S. patent application Ser. No. 12/408,540, filed on Mar. 20, 2009, and entitled, "ACTIVITY DETECTION IN MEMS ACCELEROMETERS," the disclosure of which is incorporated herein, in its entirety, by reference.

Accordingly, various embodiments can power down the hearing instrument 10 when it has been inactive for longer than a set period of time. For example, the control module 42 may power down some or all of the signal module 40 if it detects inactivity for six seconds or longer. Thus, in that example, the hearing instrument 10 is considered active even if stationary for less than six seconds. Alternative embodiments may augment this by having logic within the control module 42 that determines the orientation of the hearing instrument 10. Specifically, the shape of the hearing instrument 10 may cause it to be in a certain orientation when lying on a planar surface (e.g., on a user's night table). This orientation can be different than those of the hearing instrument 10 when in use. Accordingly, before powering down after the predetermined amount of time of inactivity has elapsed, the control module 42 also checks the orientation of the hearing instrument 10.

Before powering down, the control module 42 saves the current settings of the hearing instrument 10 (e.g., the volume, program, etc. . . . ) (step 402), and then powers down (step 404). The process loops back to step 400 to wait for activity. In addition to, or instead of, the methods discussed above, the control module 42 may have a polling module that polls the inertial sensor 46 at certain time intervals. In either case, the minute amount of power (e.g., 1 microamp or less) drawn by the inertial sensor(s) 46 should not significantly impact overall power consumption of the hearing instrument 10. For example, the inertial sensor 46 may draw less than about 10 percent of the total power draw of the hearing instrument 10 during an entire 24 hour period if its microphone 17 is on for 16 of those hours (⅔ of the total time period).

Regardless of whether the overall hearing instrument 10 is powered on or powered down, the inertial sensor 46 remains on all the time in such embodiments. Of course, the overall power draw is much less during the periods when the microphone 17 and other major electronics are off and the inertial sensor 46 and its corresponding electronics are on. Other embodiments, however, may have a knob or other mechanical means to power down the inertial sensor 46 and its corresponding electronics. In yet other embodiments, to save power, the inertial sensor 46 can power down and periodically wake itself up to check for activity.

If step 400 detects activity, however, then the process continues to step 406, in which it powers up and initializes itself, if not already powered up. The hearing instrument 10 thus continues its normal operation, During operation (i.e., when powered up), the control module 42 monitors the system 1) to detect inactivity, and 2) to determine if the user has tapped the hearing instrument 10 or his/her head (step 408). Rather than a tap, however, some embodiments may monitor the system for other inertial signals, such as a push on the outside surface of the hearing instrument 10.

If, at step 408, the control module 42 detects a tap for controlling volume, then it adjusts the volume appropriately at step 410. For example, as noted above, a user may tap the top of a hearing instrument 10 to increase the volume, or tap the back of the hearing instrument 10 to decrease the volume. After adjusting the volume, the process loops back to step 408 to wait for monitor the system for more taps or inactivity. Again, as noted above, if the control module 42 detects inactivity at any time during this process, it can take the "inactivity" path from the block for step 408 and thus, power down the entire hearing instrument 10. In that case, the control module 42 interrupts current processes, whatever they may be, to perform the power down steps of steps 402 and 404.

If the tap detected at step 408 is not one for adjusting the volume, then the control module 42 may cause the signal module 40 to change its program. For example, each such tap can cause the signal module 40 to cycle through each of its program modes. After adjusting the program, the process loops back to step 408 to wait for other taps, or determine if there is inactivity.

It should be noted that steps 410 and 412 continue until interrupted—when the control module 42 detects inactivity. Accordingly, the linear placement of the steps in the flow chart is not intended to suggest a linear progression of all of these steps. In fact, if the control module 42 detects inactivity (from the inertial sensor 46), then it can shut down the hearing instrument 10 even if it is executing its start-up processes. In illustrative embodiments, the process shuts down the hearing instrument 10 very quickly after detecting inactivity. Some embodiments, however, permit the hearing instrument 10 to complete certain processes, other than those discussed, after detecting inactivity.

Those skilled in the art can expand this process to control functions other than the volume and program. Accordingly, discussion of volume and program adjustments is for illustrative purposes and not intended to limit all embodiments of the invention. Moreover, the inertial sensor 46 in illustrative embodiments controls the operation of the instrument 10—it does not participate in the conditioning of the signal in the signal chain within the signal module 40. For example, the inertial sensor 46 has no impact on filtering or compressing the input audio signal.

Accordingly, illustrative embodiments eliminate or reduce the number of mechanical controllers 16 on a hearing instrument 10, thus facilitating use and improving device robustness. In addition, in many embodiments, the power control capabilities reduce the likelihood that a user forgets to shut off the instrument 10, thus saving battery life.

Although the above discussion discloses various exemplary embodiments of the invention, it should be apparent that those skilled in the art can make various modifications that will achieve some of the advantages of the invention without departing from the true scope of the invention.

What is claimed is:

1. A hearing instrument comprising:

a body of a hearing aid or cochlear implant;

a plurality of electronic components within the body, including a transducer;

an inertial sensor mechanically coupled with the body, the inertial sensor being configured to monitor the motion of the body and generate a movement signal representative of the body motion and representative of a first program in a plurality of programs; and a controller operatively coupled with the inertial sensor, the controller configured to process the movement signal to detect a recognizable movement pattern associated with the first program and control power usage by at least one or more of the electronic components as a function of the movement signal, wherein the inertial sensor draws less than about 10 percent of a total power draw of the hearing instrument during a given period if the transducer is on about ⅔ of the given period, and wherein the recognizable movement pattern is associated with a predetermined tapping pattern on a head of a user wearing the hearing instrument.

2. The hearing instrument as defined by claim 1 wherein the inertial sensor comprises a low power accelerometer that draws no more than about one microamp of current during operation.

3. The hearing instrument as defined by claim 1 wherein the controller permits the electronic components to consume a first amount of power in a first mode, the controller permitting the electronic components to consume a second amount of power in a second mode, the first amount of power being less than the second amount of power.

4. The hearing instrument as defined by claim 3 wherein the body is substantially stationary when in the first mode, the second mode being defined by a time period in which the body is moving during at least some portion of the time period.

5. The hearing instrument as defined by claim 1 wherein the controller comprises logic for determining when the body is substantially stationary for a pre-defined period of time.

6. The hearing instrument as defined by claim 1 wherein the controller includes a polling apparatus operatively coupled with the inertial sensor, the polling apparatus periodically polling the inertial sensor at a fixed time interval to determine whether to change the power to at least some of the electronic components.

7. The hearing instrument as defined by claim 1 comprising an implantable portion and an external portion for communicating with the implantable portion, the external portion and implantable portion having corresponding induction coils for permitting the external portion to power the implantable portion, the electronic components being a part of the external portion.

8. The hearing instrument as defined by claim 1 further comprising a power module for powering at least some of the electronic components, the controller being operatively coupled with the power module to control power consumption of at least some of the electronic components.

9. The hearing instrument as defined by claim 1, wherein:

the controller is further configured to adjust a volume of the hearing instrument in response to detecting the recognizable movement pattern.

10. The hearing instrument as defined by claim 1, wherein:

the transducer detects an acoustic signal that is processed differently for the first program and a second program in the plurality of programs;

the first program causes the acoustic signal to be processed using a filter for noisy environments;

the second program causes the acoustic signal to be processed using a filter for quiet environments.

11. The hearing instrument as defined by claim 1, wherein:

the transducer detects an acoustic signal that is processed differently for the first program and a second program in the plurality of programs;

the first program causes the acoustic signal to be processed using a filter for a room having a first size;

the second program causes the acoustic signal to be processed using a filter for a room having a second size smaller than the first size.

12. A method of operating a hearing instrument including a transducer, the method comprising:

determining, for a given period of time, if the hearing instrument is substantially stationary, the hearing instrument being a hearing aid or a cochlear implant; and controlling the hearing instrument to draw power as a function of the act of determining, wherein an inertial sensor draws less than about 10 percent of a total power draw of the hearing instrument during a given period if the transducer is on about ⅔ of the given period, the hearing instrument drawing power at a first rate after determining that the hearing instrument is substantially stationary, the hearing instrument drawing power at a second rate after determining that the hearing instrument is not substantially stationary, the first rate being less than the second rate, and a controller operatively coupled with the inertial sensor detecting a recognizable movement pattern associated with a first program in a plurality of programs, where the recognizable movement pattern is associated with a predetermined tapping pattern on a head of a user wearing the hearing instrument.

13. The method of operating a hearing instrument as defined by claim 12 wherein determining comprises receiving a signal from an inertial sensor indicating whether or not the hearing instrument is substantially stationary.

14. The method of operating a hearing instrument as defined by claim 13 wherein the inertial sensor comprises a low power, low-G MEMS accelerometer.

15. The method of operating a hearing instrument as defined by claim 13 wherein determining comprises periodically polling the inertial sensor at a fixed time interval or receiving an interrupt from the inertial sensor.

16. The method of operating a hearing instrument as defined by claim 12 wherein the hearing instrument includes a transducer configured to draw power when in use, wherein power is not supplied to the transducer when power is supplied to the hearing instrument at the first rate.

17. The hearing instrument as defined by claim 1, wherein the movement signal is an interrupt signal indicating to change a rate at which the hearing instrument draws power.

18. The method of operating a hearing instrument as defined by claim 13 wherein the signal that is received from the inertial sensor is an interrupt signal indicating to change the rate at which the hearing instrument draws power.

* * * * *